US007892003B2

(12) United States Patent
Reusche et al.

(10) Patent No.: US 7,892,003 B2
(45) **Date of Patent: *Feb. 22, 2011**

(54) TOOL HAVING INTEGRAL PLUG

(75) Inventors: Thomas K. Reusche, Elburn, IL (US); Philip E. Chumbley, Aurora, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 101 days.

This patent is subject to a terminal disclaimer.

(21) Appl. No.: 12/345,911

(22) Filed: Dec. 30, 2008

(65) Prior Publication Data

US 2009/0111305 A1 Apr. 30, 2009

Related U.S. Application Data

(63) Continuation-in-part of application No. 12/028,257, filed on Feb. 8, 2008.

(60) Provisional application No. 60/895,324, filed on Mar. 16, 2007, provisional application No. 60/909,275, filed on Mar. 30, 2007, provisional application No. 60/980,215, filed on Oct. 16, 2007.

(51) Int. Cl.
*H01R 13/52* (2006.01)

(52) U.S. Cl. ..... 439/271; 439/320; 439/359; 411/437

(58) Field of Classification Search ..... 439/638, 439/271, 320, 359, 106, 107; 411/417, 418, 411/437
See application file for complete search history.

(56) References Cited

U.S. PATENT DOCUMENTS

| | | | | |
|---|---|---|---|---|
| 2,635,219 | A * | 4/1953 | Blondet | 318/274 |
| 3,858,956 | A * | 1/1975 | Garrett | 439/106 |
| 3,938,873 | A * | 2/1976 | Kimball | 439/568 |
| 4,059,332 | A * | 11/1977 | Phillips et al. | 439/490 |
| 4,101,756 | A * | 7/1978 | Yamano | 219/222 |
| 4,907,985 | A * | 3/1990 | Johnsen | 439/369 |
| 5,124,532 | A * | 6/1992 | Hafey et al. | 219/200 |
| 5,964,621 | A * | 10/1999 | Wolla et al. | 439/595 |
| 6,368,133 | B1 * | 4/2002 | Zeiler et al. | 439/321 |
| 6,703,587 | B2 * | 3/2004 | Sena et al. | 219/222 |

* cited by examiner

*Primary Examiner*—Tho D Ta
*Assistant Examiner*—Travis Chambers
(74) *Attorney, Agent, or Firm*—McAndrews, Held & Malloy, Ltd.

(57) ABSTRACT

An electrical tool includes a main housing, an operative portion integrally connected to, and forming part of, the main housing, and a plug integrally connected to, and forming part of, the main housing. The plug comprising a base or main body, a plug connecting interface and first and second spades extending from the plug connecting interface. The first and second spades are in a standard configuration.

37 Claims, 5 Drawing Sheets

TOOL HAVING INTEGRAL PLUG

RELATED APPLICATIONS

The present application is a continuation-in-part of U.S. application Ser. No. 12/028,257, entitled "Cordset Assembly," filed Feb. 8, 2008, which, in turn, relates to and claims priority from U.S. Provisional Application No. 60/895,324, entitled "Water-Resistant Locking Cordset," filed Mar. 16, 2007, U.S. Provisional Application No. 60/909,275, entitled "Water-Resistant Locking Cordset," filed Mar. 30, 2007 and U.S. Provisional Application No. 60/980,215, entitled "Water-Resistant Locking Cordset," filed Oct. 16, 2007, all of which are hereby incorporated by reference in their entireties.

FIELD OF THE INVENTION

Embodiments of the present invention generally relate to tool, such as a work light, hedge trimmer, drill or the like, and more particularly, to a tool having an integrally formed plug that is part of the main structure of the tool itself.

Embodiments of the present invention also generally relate to an extension cordset assembly having a male plug and a female receptacle, and more particularly, to a water-resistant locking extension cordset assembly.

BACKGROUND OF THE INVENTION

Extension cordsets are used in homes and businesses in order to connect appliances and electronic equipment to a source of power. Typically, cordsets are designed for indoor use and configured to carry 10 amperes or less of current. Other common heavy-duty cordsets are designed to provide power to tools or machinery. While the heavy-duty cordsets may be rated for outdoor use, the rating typically applies to the water resistance of the plastic jacketing on the cord and molded pieces without addressing the ability of the cordset connections to resist moisture.

A large proportion of outdoor cordsets are used in agricultural or construction settings where they provide power for operating a hand-held power tool such as a drill or circular saw. The extension cordsets in these settings allow a user to operate a tool at a remote distance from a power outlet. Thus, the user may move about a work site with the tool.

The male plug of a tool, however, may be susceptible to disconnecting from the female receptacle of an outdoor cordset. In order to prevent the male plug from disconnecting from the female receptacle, some users tie an end of the power tool cord and an end of the extension cordset in a knot. However, the act of physically tying the cords together may be annoying to some users. Additionally, the knotted connection may not always be secure. Further, tying the cords together inherently decreases the length of the extension.

Also, the interface between the extension cordset and the power tool cord may be exposed to water, for example, in a puddle, where the cord may short to ground. Alternatively, the male plug and the female receptacle may partially disengage from one another, thereby exposing live electrical contacts. As such, typical extension cordsets may present a danger to users and others as well as presenting a fire hazard. This same hazard can be found in cordsets for supplying power to recreational vehicles and electric motors, for example.

Specialty cordsets exist to ensure a secure, water resistant connection between the male plug and the female receptacle. However, these specialty cordsets typically include a unique, specifically designed male and female attachment to mate the two cords together. For instance, the common two- or threeprong plug that would be found on a 120 volt device for plugging into a standard wall outlet typically cannot be used in conjunction with the specialty cordsets, thereby limiting their practicality.

Work lights, also referred to as trouble lights or service lights, have been used in various contexts. For example, work lights are positioned in a dark area where work is to be performed. A typical work lights includes a light socket within a housing that contains a switch for operation of the light along with a shield on one side of the light to prevent it from shining into a worker's eyes. The work light also typically includes a cage on the opposite side of the shield to protect the bulb. A cord, ranging in length from 10 to 50 feet long, is typically attached to the housing so that the light may be used a distance from a power source. Many work lights also include an electrical socket to allow another electrical device to be plugged therein so that the work light also functions as an extension cord for another work light or other device.

When purchasing a work light, a user typically buys a length of cord along with the light where the cord may be much longer than ever needed. Accordingly, the user ends up spending extra money for the cord, or the cord may be too short for various applications. Additionally, the cord itself may be ungainly to use as an extension cord due to the light structure at one end. Further, a large length of cord may be cumbersome and obtrusive when only a small length of cord is needed for a particular application.

Various other electrical tools, such as hedge clippers, weed wackers, drills, and the like are plagued by similar disadvantages.

SUMMARY OF THE INVENTION

Certain embodiments of the present invention provide an extension cordset assembly configured to provide electrical power from a standard outlet to an electrical device. The extension cordset assembly includes a plug, a receptacle and a sealing gasket. Optionally, the extension cordset assembly does not include the sealing gasket.

The plug includes a main body that may be triangular to facilitate use with standard electrical outlet and receptacle configurations. The plug also includes a connecting interface and a first spade, a second spade and a ground pin extending from the plug connecting interface.

The receptacle includes a main body that may be triangular in order to facilitate use with standard configurations. The receptacle also includes a receptacle connecting interface and first and second spade mating holes and a ground pin mating hole extending into the receptacle main body from the receptacle connecting interface.

The sealing gasket may also be triangular and is configured to be compressively sandwiched between another plug connecting interface and the receptacle connecting interface. The sealing gasket includes first and second spade openings aligned with the first and second spade mating holes, respectively, and a ground pin opening aligned with the ground pin mating hole. A sealing ridge may extend about a periphery of the sealing gasket. The sealing gasket may also include first and second sealing rims surrounding the first and second space openings, respectively, and a third sealing rim surrounding the ground pin opening.

The extension cordset assembly may also include a first connecting nut rotatably secured to the receptacle main body. The connecting nut is configured to threadably secure to a portion of another plug in order to secure the receptacle to the other plug.

The extension cordset assembly may also include a second connecting nut configured to threadably secure to the receptacle main body. The second connecting nut ensures that the first connecting nut remains on the receptacle main body.

The receptacle main body may also include a backstop that ensures that the second connecting nut remains on the receptacle main body.

The plug may also include an upstanding rim surrounding the plug connecting interface. The upstanding rim may cooperate with the gasket to form a sealing interface between the plug and the receptacle.

The receptacle connecting interface may include first and second spade rims surrounding the first and second spade mating holes, respectively, and a ground pin rim surrounding the ground pin opening. The first and second spade rims are positioned within the first and second spade openings, respectively, and the ground pin rim is positioned within the ground pin opening.

Certain embodiments of the present invention provide an electrical plug that includes a main body having a connecting interface, and a pair of electrical spades extending from the connecting interface. The main body includes threads on an outer surface thereof. The threads are configured to threadably engage threads formed on a connecting nut of a receptacle in order to securely connect the electrical plug to the receptacle.

The main body may include a plurality of apexes or corners, wherein the threads are located at the apexes. A rim may surround the connecting interface.

Certain embodiments of the present invention provide an extension cordset assembly that includes a plug and a receptacle. The plug includes a plug main body, a plug connecting interface and a first spade and a second spade extending from the plug connecting interface. The receptacle connects to the plug through an insulated cord. The receptacle may include a receptacle main body, a receptacle connecting interface and first and second spade mating holes extending into the receptacle main body from the receptacle connecting interface.

A first connecting nut rotatably secured to said receptacle main body is configured to threadably secure to another plug main body in order to secure the receptacle to the other plug.

At least a portion of the plug main body is threaded in order to threadably secure to another first connecting nut. A second connecting nut may be configured to threadably secure to the receptacle main body such that the second connecting nut ensures the first connecting nut remains on the receptacle main body.

Certain embodiments of the present invention provide an extension cordset assembly that includes a plug and a receptacle. The plug includes a plug main body, a plug connecting interface and first and second spades extending from the plug connecting interface, wherein the first and second spades are in a standard configuration.

The receptacle is connected to the plug through an insulated cord and includes a receptacle main body, a receptacle connecting interface and first and second spade mating holes extending into the receptacle main body from the receptacle connecting interface.

One or both of the plug connecting interface and the receptacle connecting interface are configured to provide a water-resistant seal with respect to another receptacle or another plug, respectively. For example, the connecting interfaces may be formed of elastomeric or foam material integrally formed with the main bodies.

Certain embodiments of the present invention provide an electrical tool that includes a main housing, an operative portion integrally connected to, and forming part of, the main housing, and a plug integrally connected to, and forming part of, the main housing. The plug includes a base, a plug connecting interface and first and second spades extending from the plug connecting interface, wherein the first and second spades are in a standard configuration.

The operative portion of the main housing may include a light housing, movable clippers, rotating drill bit or the like. Further, the main housing may be devoid of an electrical cord that connects to the plug. That is, the plug forms part of the main housing, and is not connected thereto through a separate electrical cord that would allow the plug to move independently of the main housing (e.g., dangle from the main housing).

Certain embodiments of the present invention provide an electrical tool that includes a main housing integrally connected to an operative portion, a plug integrally connected to the main housing, wherein the plug forms part of the main housing.

The plug may include a main body having a connecting interface; and a pair of electrical spades extending from the connecting interface. The main body may includes threads on an outer surface thereof. The threads are configured to threadably engage reciprocal threads formed within a connecting nut of a receptacle in order to securely connect the electrical plug to the receptacle.

An axial cross section of the main body may be triangular or circular. The main body may include a plurality of apexes, wherein the threads are located at the plurality of apexes. Further, the main body may be devoid of an electrical cord that connects to the plug.

Certain embodiments of the present invention provide a work light that includes a gripping handle, an intermediate stem integrally connected to a first end of the gripping handle, a light housing integrally connected to the intermediate stem, and a plug integrally connected to a second end of the gripping handle.

The plug may include a base having threads on an outer surface thereof. The threads may be configured to threadably engage reciprocal threads formed within a connecting nut of a receptacle in order to securely connect the electrical plug to the receptacle. The plug may also include a plug connecting interface and first and second spades extending from the plug connecting interface, wherein the first and second spades are in a standard configuration.

The work light may be devoid of an electrical cord that connects the plug to the gripping handle. Further, the gripping handle and the base of the plug may be integrally molded together to form a single piece.

Figure 1:
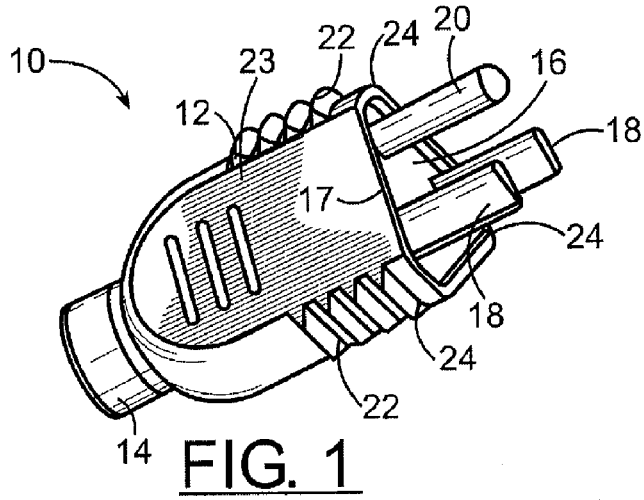
FIG. 1 illustrates an isometric view of a male plug according to an embodiment of the present invention.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of a male plug 10 according to an embodiment of the present invention. The male plug 10 includes a generally triangular main body 12, which may be formed of plastic, connected to a collar 14, which in turn connects to an insulated electrical cord (not shown). The main body 12 may be triangular to facilitate standard electrical outlets and connections. The main body 12 may be molded from, and/or coated with, insulated plastic. Optionally, the main body 12 may be integrally formed with and connected to an insulated electrical cord. In short, the collar 14 shown in FIG. 1 may be an end of an insulated electrical cord.

A connecting interface 16 is distally located from the collar 14 at an opposite end of the collar 14. An upstanding rim 17 circumscribes the connecting interface 16. A female receptacle is configured to mate into the connecting interface 16, as discussed below.

Two conducting spades or blades 18 and a ground pin 20 extend outwardly from the connecting interface 16. The spades 18 and the ground pin 20 are configured to mate with reciprocal openings formed in a female receptacle, as shown and discussed with respect to FIG. 2. The spades 18 and the ground pin 20 are configured to plug into any standard electrical outlet. The configuration of the male plug 10 may be adapted to a standard spade and ground pin configuration. As shown in FIG. 1, the spades 18 and the ground pin 20 meet the dimension requirements as set forth in FIG. 5-15 of the NEMA Standards Publication ANSI/NEMA WD 6-2002 for a 125 volt, 15 amp, 2 pole, 3 wire, grounding type plug. Alternatively, the male plug 10 may be adapted to various other electrical configurations, such as a 120 volt or 240 volt configuration and/or a 20 amp configuration. Optionally, the male plug 10 may not include the ground pin 20.

The male plug 10 may be a two or three wire assembly suitable for outdoor use. Typical designations for the male plug 10 include SJTW and SJTOW, among others.

Threads 22 are formed on an outer surface of the main body 12 between a middle portion 23 and the connecting interface 16. As shown in FIG. 1, the threads 22 do not extend over an entire outer perimeter of the main body 12. Instead, the threads 22 are formed at apexes or corners 24 of the main body 12. Optionally, the threads 22 may extend over the entire outer perimeter of the main body 12. Moreover, the threads 22 may be formed from the collar 14 to the connecting interface 16.

Figure 2:
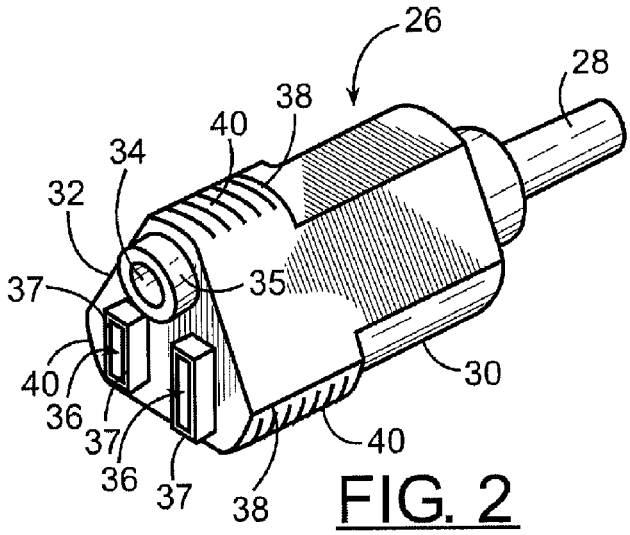
FIG. 2 illustrates an isometric view of a female receptacle according to an embodiment of the present invention.

FIG. 2 illustrates an isometric view of a female receptacle 26 according to an embodiment of the present invention. The female receptacle 26 may be connected to the male plug 10 (shown in FIG. 1) through an insulated cord 28, thereby forming an extension cordset. Thus, a male plug 10 of one extension cordset may be mated with a female receptacle 26 of another extension cordset. Moreover, the female receptacle 26 may be mated with a male plug of an electrical device, such as a power tool.

The female receptacle 26 includes a generally triangular main body 30 connected to the insulated electrical cord 28. The main body 30 may be formed of, and/or coated with, insulated plastic and includes a connecting interface 32 at an end opposite of the cord 28.

A ground pin mating hole 34 is formed through the connecting interface 32 and is configured to receive the ground pin 20 of the male plug 10 (shown in FIG. 1). A circular rim or tube 35 outwardly extends from the connecting interface 32 and surrounds the ground pin mating hole 34. Similarly, two spade mating holes 36 are formed through the connecting interface 32 and are configured to receive the spades 18 (shown in FIG. 1). Rectangular rims or walls 37 extend outwardly from the connecting interface 32 and surround the spade mating holes 36. The mating holes 34 and 36 may be configured the same as those found on a common electrical outlet and are configured to accept the electrical spades 18 and the ground pin 20 of the male plug 10 (shown in FIG. 1), as well as two-prong plugs that are polarized or un-polarized.

Shelves 38 are formed at apexes 40 of the main body 30. Optionally, the shelves 38 may extend around an entirety of the main body 30. The shelves 38 are configured to ensure that a connecting nut rotatably secures to the female receptacle 26, as discussed below.

Figure 3:
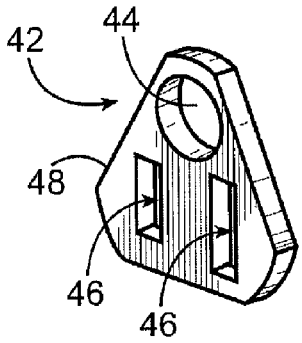
FIG. 3 illustrates an isometric view of a sealing gasket according to an embodiment of the present invention.

FIG. 3 illustrates an isometric view of a sealing gasket 42 according to an embodiment of the present invention. The sealing gasket 42 may be formed of a material that is softer than the main body 30 of the female receptacle 26. For instance, the gasket 42 may be formed of an elastomeric or foam material that is compressible and moisture resistant.

A circular grounding rim opening 44 is formed through the gasket 42. Additionally, rectangular spade rim openings 46 are formed through the gasket 42. The grounding rim opening 44 and the spade rim openings 46 are configured to receive the circular rim 35 and the rectangular rims 37, respectively (shown in FIG. 2). When the gasket 42 is positioned over the connecting interface 32, the exposed ends of the rims 35 and 37 are flush with the exposed surface 48 of the gasket 42. Further, when the male plug 10 (shown in FIG. 1) is mated with the female receptacle 26, the gasket 42 is bounded by the rim 17 (shown in FIG. 1) of the male plug 10 and is compressively sandwiched between the connecting interface 16 (shown in FIG. 1) of the male plug 10 and the connecting interface 32 of the female receptacle 26. As such, the gasket 42 provides a water-resistant seal between the connecting interfaces 16 and 32.

The gasket may be various other shapes and sizes that those shown in FIG. 3. For example, the gasket may be shaped as a ring or outer loop of material with a central opening. As such, the outer loop is configured to contact a connection interface, such as an upturned plug lip. The gasket may also be an O-ring configured to be retained within a groove formed in the plug and/or the receptacle.

While the gasket 42 is described above as attaching to the connecting interface 32 of the female receptacle 26, the plug 10 may be alternatively configured to include rims around portions of the spades 18 and ground pin 20. In this way, the gasket 42 may be attached to the plug 10. In this arrangement, the female receptacle 26 may not include the rims 35 and 37, but may include an upstanding rim surrounding the connecting interface 32.

Figure 4:
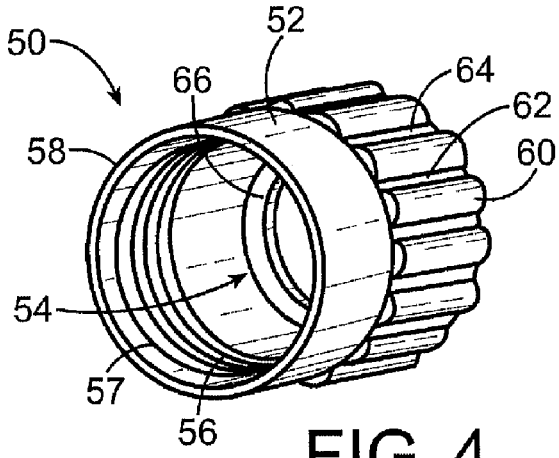
FIG. 4 illustrates an isometric view of a connecting nut according to an embodiment of the present invention.

FIG. 4 illustrates an isometric view of a connecting nut 50 according to an embodiment of the present invention. The nut 50 includes a generally cylindrical wall 52 defining an interior passage 54. An interior surface 56 of the wall 52 is threaded 57 at one end 58. Ribs 60 outwardly extend from an outer surface 62 of the wall 52 proximate another end 64. The ribs 60 provide structures for a user to easily grasp so that the user may rotate the nut 50 when it is connected to the female receptacle 26 (shown in FIG. 2).

Referring to FIGS. 2 and 4, the nut 50 is positioned on the female receptacle 26 so that the main body 30 is positioned within the interior passage 54. That is, the nut 50 surrounds the main body 30 while exposing the connecting interface 32. The shelves 38 formed at the apexes 40 of the main body 30 abut into the interior surface 56 of the cylindrical wall 52 of the nut 50, thereby preventing the nut 50 from separating from the female receptacle 26. For example, a ledge 66 may extend from the interior surface 56 and into the interior passage 54. If the nut 50 axially shifts with respect to the female receptacle 26, the ledge 66 is blocked from further movement by the shelves 38. While the shelves 38 prevent the nut 50 from slipping off the female receptacle 26, the nut 50 is otherwise free to rotate about the main body 30 of the female receptacle 26.

Figure 5:
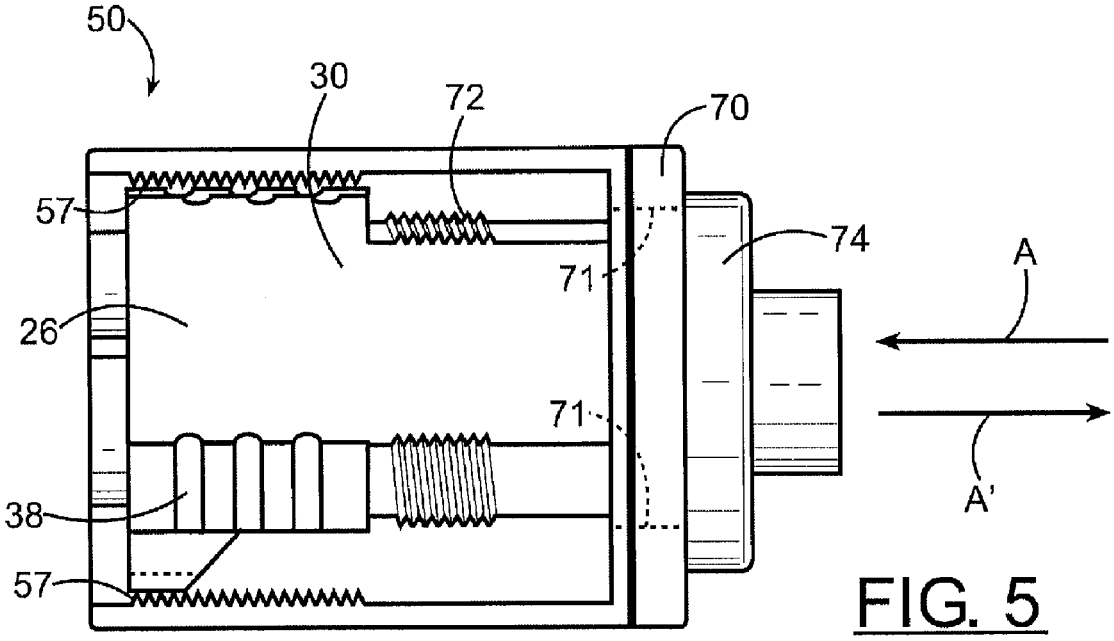
FIG. 5 illustrates a simplified, partial cross-sectional view of a connecting nut secured to a female receptacle according to an embodiment of the present invention.

FIG. 5 illustrates a simplified, partial cross-sectional view of the connecting nut 50 secured to the female receptacle 26 according to an embodiment of the present invention. A second, thinner nut 70 may be tightened against the connecting nut 50 to prevent the nut 50 from loosening during operation.

The nut 70 includes a smaller opening or interior passage 71 than that of the nut 50. As shown in FIG. 5, the nut 70 is configured to threadably engage threads 72 formed around a recessed portion of the main body 30. As the nut 70 is urged in the direction of arrow A, the nut 50 also moves in the same direction, thereby moving the threads 57 away from the main body 30 in the direction of arrow A. The nut 70 then threadably engages the threads 72 in order to secure the nut 70 to the female receptacle 26, thereby preventing the nut 50 from retreating in the direction of arrow A'.

The female receptacle 26 may also include a backstop 74 behind the nut 70 that prevents the nut 70 from slipping off the female receptacle 26. As shown in FIG. 5, the diameter of the backstop 74 is greater than the opening 71 formed through the nut 70. As such, the backstop 74 provides a stop that prevents the nut 70 from slipping past in the direction of arrow A'.

Once the nut 70 threadably engages and securely tightens to the female receptacle 26, the nut 50 is free to rotate about the female receptacle 26, but is prevented from retreating in the direction of arrow A'. In this position, the nut 50 may threadably secure to the male plug 10 shown in FIG. 1.

Referring to FIGS. 1-5, the nut 50 secures to the male plug 10 by the threads 57 engaging the threads 22 of the male plug 10. Once securely tightened, the nut 50 ensures that the male plug 10 is securely connected to the female receptacle 26. That is, the nut 50 is tightened around the male plug 10 to prevent the male plug 10 from disconnecting from the female receptacle 26. Further, as the nut 50 threadably engages the male plug 10, the gasket 42 is compressively sandwiched between the connecting interfaces 16 and 32 of the male plug 10 and the female receptacle 26, respectively, thereby providing a secure, water-resistant connection between the male plug 10 and the female receptacle 26.

Figure 6:
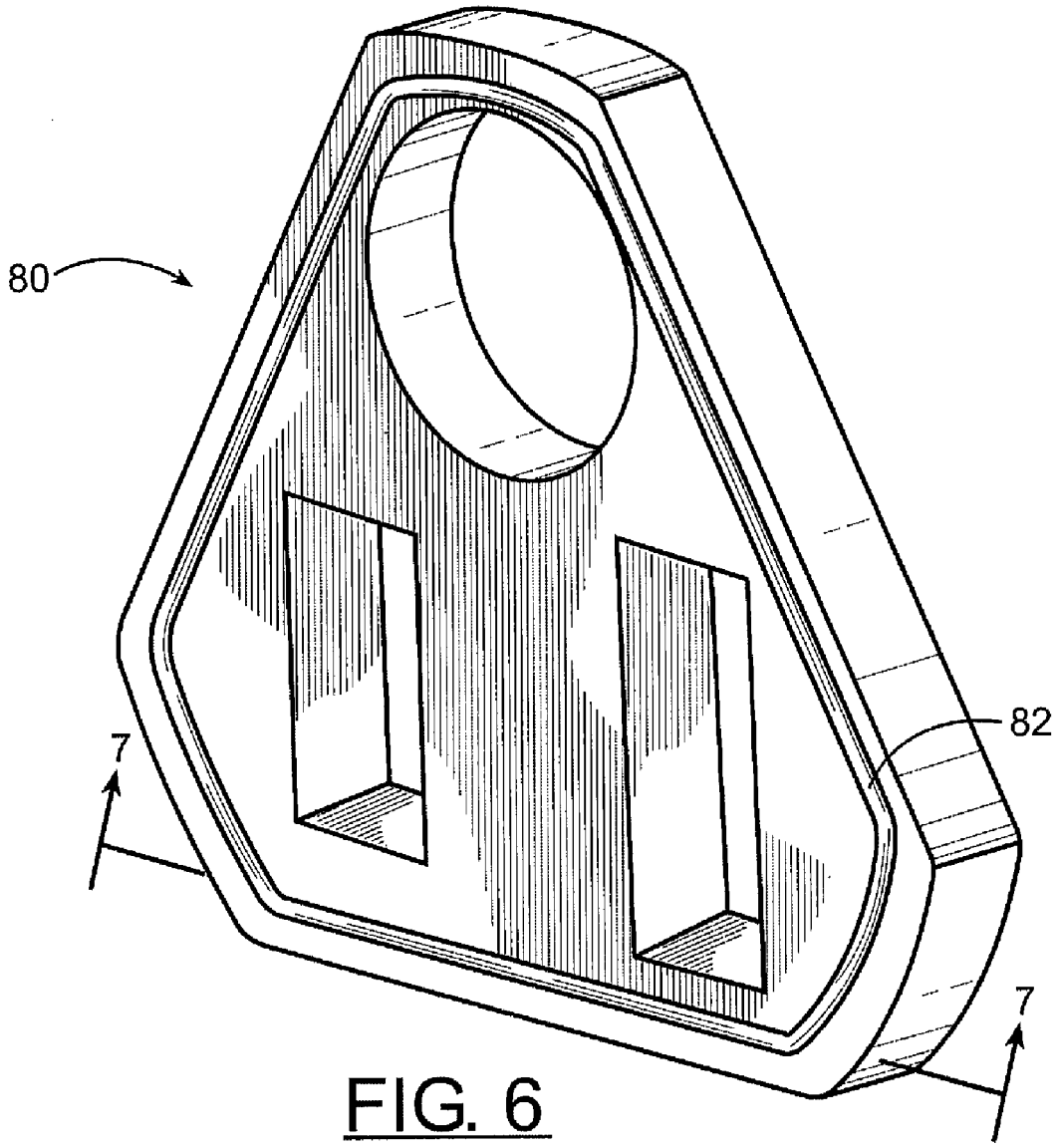
FIG. 6 illustrates an isometric front view of a gasket according to an embodiment of the present invention.
Figure 7:
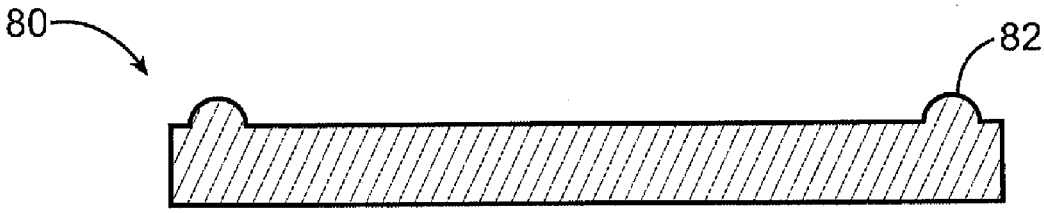
FIG. 7 illustrates a cross-sectional view of a gasket through line 7-7 of FIG. 6 according to an embodiment of the present invention.

FIG. 6 illustrates an isometric front view of a gasket 80 according to an embodiment of the present invention. FIG. 7 illustrates a cross-sectional view of the gasket 80 through line 7-7 of FIG. 6. As shown in FIGS. 6 and 7, a raised ridge 82 is formed around a periphery of the gasket 80. The gasket 80 may be used with the male plug 10 and the female receptacle 26 shown and described in FIGS. 1 and 2. In this case, the male plug 10 may not include the raised rim 17 (shown in FIG. 1) circumscribing the connecting interface 16 (shown in FIG. 1). Instead, the raised ridge 82 compresses between the connecting interfaces 16 and 32 and may provide a suitable seal between the male plug 10 and the female receptacle 26. However, the raised rim 17 may be used to provide additional sealing.

Figure 8:
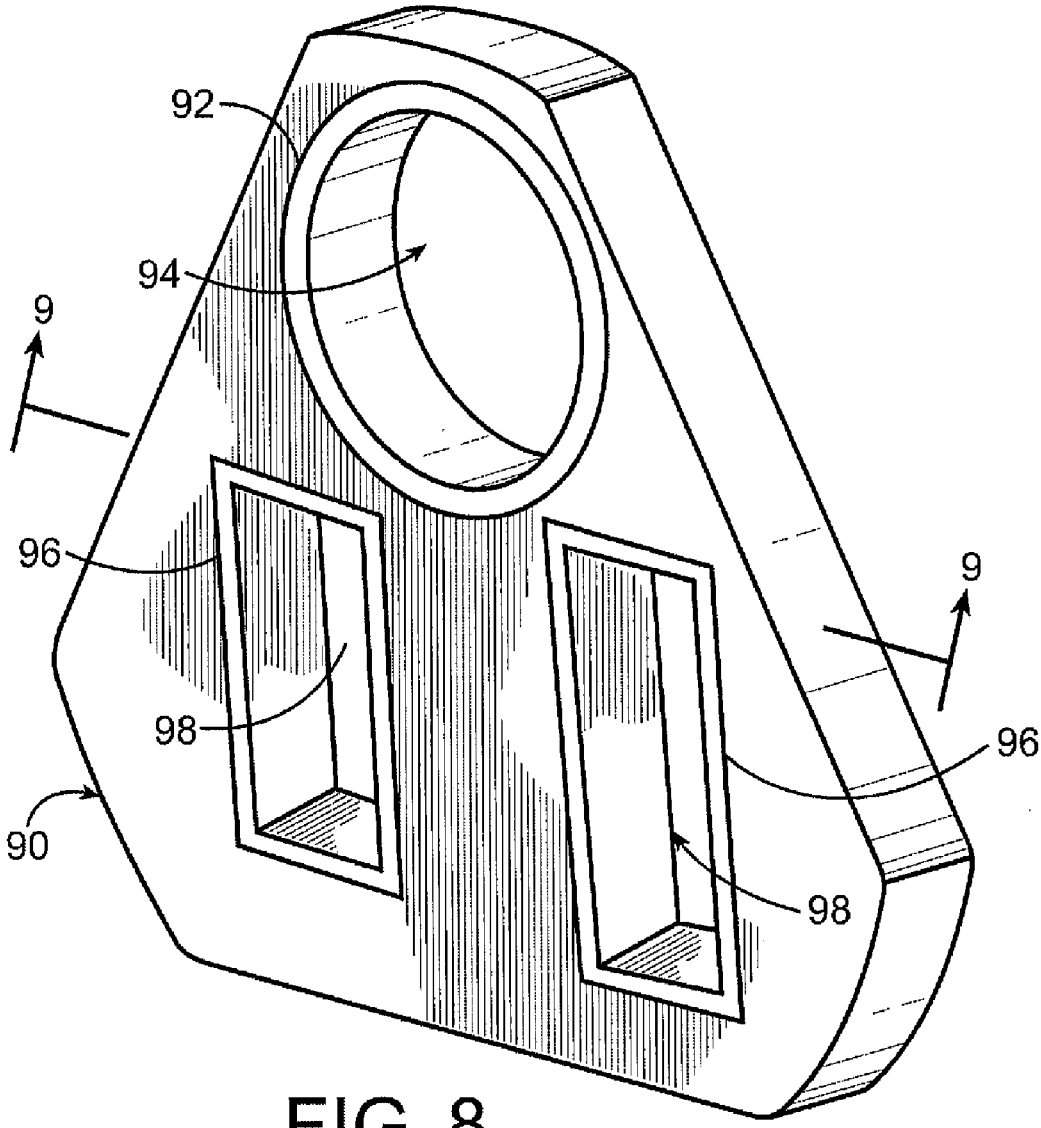
FIG. 8 illustrates an isometric front view of a gasket according to an embodiment of the present invention.
Figure 9:
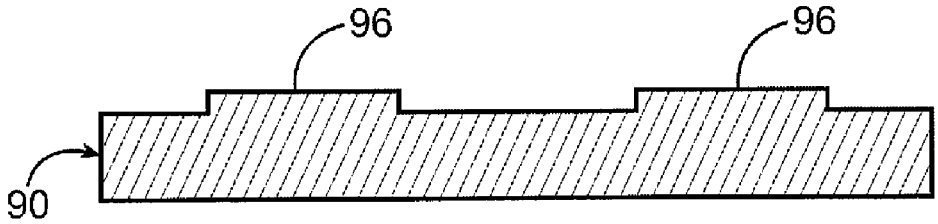
FIG. 9 illustrates a cross-sectional view of a gasket through line 9-9 of FIG. 8 according to an embodiment of the present invention.

FIG. 8 illustrates an isometric front view of a gasket 90 according to an embodiment of the present invention. FIG. 9 illustrates a cross-sectional view of the gasket 90 through line 9-9 of FIG. 8. As shown in FIGS. 8 and 9, the gasket 90 includes a raised rim 92 around a ground pin opening 94 and raised rims 96 about spade openings 98. The gasket 90 may be used with flat faced plugs and receptacles. The raised rims 92 and 96 form seals between connecting interfaces around each individual pin and spade, respectively. The area of the gasket 90 immediately surrounding each pin and spade may be thicker than the edge of the gasket 90 so as to form a positive seal around each pin and spade.

As noted above, a male plug is connected to a female receptacle through an insulated cord to form an extension cordset. The male plug of one extension cordset may be mated with a female receptacle of another extension cordset. The male plug can also be plugged into a standard outlet to provide power to a particular device. Likewise, a device without a threaded plug may be inserted into a female receptacle of the extension cordset just like a standard extension cordset. Additionally, individual cordsets may be locked together to form longer extensions.

Figure 10:
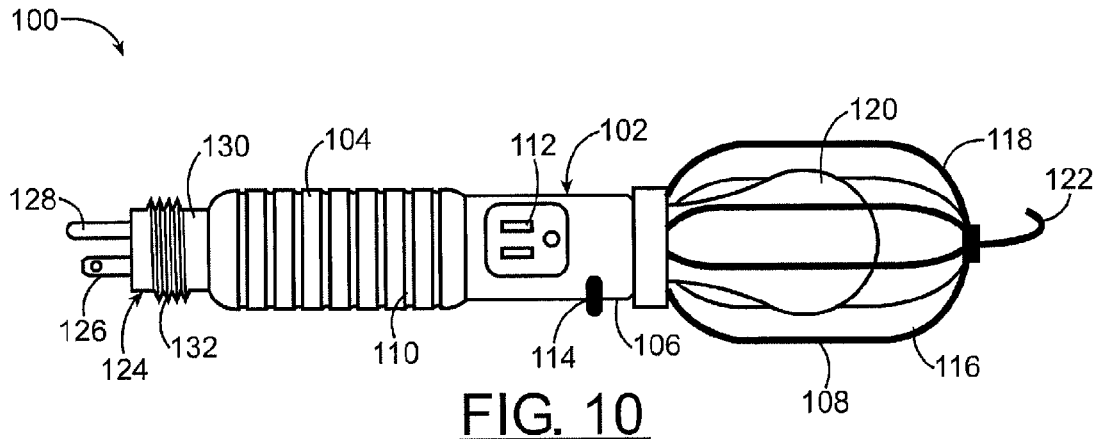
FIG. 10 illustrates a side view of work light, according to an embodiment of the present invention.

FIG. 10 illustrates a side view of work light 100, according to an embodiment of the present invention. The work light 100 includes a main housing 102 having a grip 104 integrally connected to an intermediate stem 106, which is, in turn, connected to a light housing 108. The grip 104 may be an extension of the intermediate stem 106 and includes a sleeve 110 formed of plastic or rubber that is configured to be gripped by a user.

The intermediate stem 106 includes an outlet 112 and a switch 114. The outlet 112 may mate with a plug of another device. As such, the work light 100 may serve as an electrical extension for another tool, such as another work light. The switch 114 is configured to allow a user to selectively turn activate and deactivate a bulb of the work light 100.

The work light housing 108 integrally connects to an end of the intermediate stem 106 that is distally located from the grip 104. The work light housing 108 includes a shield 116 and a cage 118 surrounding a bulb 120. A hook 122 may extend from a top portion of the housing 108 proximate the union of the cage 118 and the shield 116. The hook 122 is configured to allow a user to hang the work light 100.

A plug 124, such as shown in FIG. 1, integrally extends from an end of the grip 104. The plug 124 may be located at an end of the grip 104 that is distally located from the intermediate stem 106.

The plug 124 is part of the main housing 102 itself. That is, the plug 124 is integrally formed with the main housing 102 as a single unit. As shown in FIG. 10, the base of the plug 124 and main housing 102 may be molded and manufactured from a single piece of material, such as plastic. As shown in FIG. 10, the plug 124 does not connect to the main housing 102 through a separate and distinct electrical cord that would allow the plug 124 to dangle from the main housing 102. Instead, the plug 124 forms part of the main body or structure of the work light 100.

The plug 124 includes blades 126 and a grounding pin 128 as described above in FIG. 1. Similarly, as described above in FIG. 1, the plug 124 includes a base 130 having a series of threads 132 that are configured to threadably secure to a to a connecting nut, such as connecting nut 50 shown in FIG. 4, that allows the plug to be secured to a reciprocal female receptacle, such as the female receptacle 26 shown in FIG. 2. In general, the description regarding FIGS. 1-9 is equally applicable to the plug 124.

Thus, the work light 100 does not include any extraneous electrical cords. A user does not need to worry about purchasing too much or not enough electrical cord with respect to the work light 100. Instead, a user may merely attach separate and distinct electrical cordsets, such as described above, to tailor a length of cord to a particular application.

Figure 11:
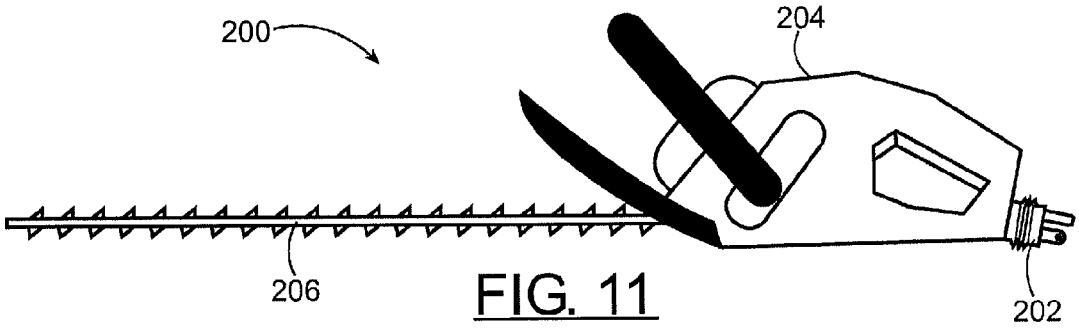
FIG. 11 illustrates a side view of a hedge clipper, according to an embodiment of the present invention.

FIG. 11 illustrates a side view of a hedge clipper 200, according to an embodiment of the present invention. Similar to the work light, the hedge clipper 200 may include a plug 202, such as any of those described above, integrally formed with a main body 204 of the hedge clipper 200, which also includes a movable clipper rack 206 extending from said main body 204. Again, the plug 202 may not be connected to the main body 204 through an electrical cord. In general, embodiments of the present invention provide a plug that may be integrally formed with a main body of any electrical tool or device.

Thus, embodiments of the present invention provide an electrical tool that may be devoid of an extraneous electrical cord. Instead, embodiments of the present invention provide an electrical tool that may include a plug integrally formed part of a main body of the electrical tool. The plug may then be mated with a reciprocal electrical receptacle of a cordset in order to provide a custom length of cord for the electrical tool.

As discussed above, various embodiments of the present invention include a sealing gasket. Alternatively, the plug and receptacle may be formed such that their connecting interfaces are formed may be formed of a material that is softer than their respective main bodies. For example, the connecting interfaces may be formed of an elastomeric or foam material that is compressible and moisture resistant. Thus, a separate and distinct gasket may not be needed with respect to these alternative embodiments. However, the gaskets described above allow standard plugs and receptacles to be retrofit to provide moisture resistance.

Thus, embodiments of the present invention provide an extension cordset that provides secure, water-resistant connections between male plugs and female receptacles. Additionally, embodiments of the present invention may be used with standard plugs, outlets and receptacle configurations.

While various spatial terms, such as upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. An electrical tool comprising:

a main housing;

an operative portion integrally connected to, and forming part of, said main housing; and a plug integrally connected to, and forming part of, said main housing, said plug comprising a base having a triangular axial cross section, a plug connecting interface and first and second spades extending from said plug connecting interface, wherein said first and second spades are in a standard configuration.

2. The electrical tool of claim 1, wherein said operative portion comprises a light housing.

3. The electrical tool of claim 1, wherein said operative portion comprises moveable clippers.

4. The electrical tool of claim 1, wherein said main housing is devoid of an electrical cord that connects to said plug.

5. The electrical tool of claim 1, comprising a first connecting nut rotatably secured to said plug, said connecting nut configured to threadably secure to receptacle main body in order to secure said plug to the receptacle.

6. The electrical tool of claim 1, wherein said plug further comprises an upstanding rim surrounding said plug connecting interface.

7. The electrical tool of claim 1, wherein said plug further comprises an upstanding rim surrounding said plug connecting interface.

8. The electrical tool of claim 1, comprising a sealing gasket configured to be compressively sandwiched between said plug connecting interface and a receptacle connecting interface, said sealing gasket configured to provide a water-resistant seal between said plug and a receptacle.

9. The electrical tool of claim 8, wherein said sealing gasket comprises a sealing ridge about a periphery of said sealing gasket.

10. The electrical tool of claim 8, wherein said sealing gasket is attached to said plug.

11. An electrical tool, comprising:

a main housing integrally connected to an operative portion;

a plug integrally connected to said main housing, wherein said plug forms part of said main housing, said plug comprising:

a main body having a connecting interface and a triangular axial cross section; and a pair of electrical spades extending from said connecting interface, wherein said main body comprises threads on an outer surface thereof, said threads configured to threadably engage reciprocal threads formed within a connecting nut of a receptacle in order to securely connect said plug to the receptacle.

12. The electrical tool of claim 10, wherein said main body comprises a plurality of apexes, wherein said threads are located at said plurality of apexes.

13. The electrical tool of claim 10, wherein said main body comprises a rim surrounding said connecting interface.

14. The electrical tool of claim 10, comprising a ground pin extending from said connecting interface.

15. The electrical tool of claim 10, wherein said operative portion comprises a light housing.

16. The electrical tool of claim 10, wherein said operative portion comprises moveable clippers.

17. The electrical tool of claim 10, wherein said main body is devoid of an electrical cord that connects to said plug.

18. A work light comprising:

a gripping handle;

an intermediate stem integrally connected to a first end of said gripping handle;

a light housing integrally connected to said intermediate stem; and a plug integrally connected to a second end of said gripping handle, said plug comprising:

a base comprising threads located at a plurality of apexes, said threads configured to threadably engage reciprocal threads formed within a connecting nut of a receptacle in order to securely connect the electrical plug to the receptacle; and a plug connecting interface and first and second spades extending from said plug connecting interface, wherein said first and second spades are in a standard configuration.

19. The work light of claim 18, wherein the work light is devoid of an electrical cord that connects said plug to said gripping handle.

20. The electrical tool of claim 18, wherein said gripping handle and said base of said plug are integrally molded together to form a single piece.

21. The work light of claim 18, wherein the work light is devoid of an electrical cord that connects said plug to said gripping handle.

22. The electrical tool of claim 18, wherein said gripping handle and said base of said plug are integrally molded together to form a single piece.

23. An electrical tool comprising:

a main housing;

an operative portion integrally connected to, and forming part of, said main housing; and a plug integrally connected to, and forming part of, said main housing, said plug comprising a base, a plug connecting interface and first and second spades extending from said plug connecting interface, wherein said first and second spades are in a standard configuration, and wherein said base comprises a plurality of apexes having threads configured to threadably engage reciprocal threads formed within a connecting nut of a receptacle in order to securely connect said plug to the receptacle.

24. The electrical tool of claim 23, wherein said operative portion comprises a light housing.

25. The electrical tool of claim 23, wherein said operative portion comprises moveable clippers.

26. The electrical tool of claim 21, wherein said main housing is devoid of an electrical cord that connects to said plug.

27. The electrical tool of claim 23, comprising a first connecting nut rotatably secured to said plug, said connecting nut configured to threadably secure to receptacle main body in order to secure said plug to the receptacle.

28. The electrical tool of claim 23, comprising a sealing gasket configured to be compressively sandwiched between said plug connecting interface and a receptacle connecting interface, said sealing gasket configured to provide a water-resistant seal between said plug and a receptacle.

29. The electrical tool of claim 28, wherein said sealing gasket comprises a sealing ridge about a periphery of said sealing gasket.

30. The electrical tool of claim 28, wherein said sealing gasket is attached to said plug.

31. An electrical tool, comprising:

a main housing integrally connected to an operative portion;

a plug integrally connected to said main housing, wherein said plug forms part of said main housing, said plug comprising:

a main body having a connecting interface and a plurality of apexes; and a pair of electrical spades extending from said connecting interface, wherein said main body comprises threads at said plurality of apexes, said threads configured to threadably engage reciprocal threads formed within a connecting nut of a receptacle in order to securely connect said plug to the receptacle.

32. The electrical tool of claim 31, wherein said main body comprises a rim surrounding said connecting interface.

33. The electrical tool of claim 31, comprising a ground pin extending from said connecting interface.

34. The electrical tool of claim 31, wherein said operative portion comprises a light housing.

35. The electrical tool of claim 31, wherein said operative portion comprises moveable clippers.

36. The electrical tool of claim 31, wherein said main body is devoid of an electrical cord that connects to said plug.

37. A work light comprising:

a gripping handle;

an intermediate stem integrally connected to a first end of said gripping handle;

a light housing integrally connected to said intermediate stem; and a plug integrally connected to a second end of said gripping handle, said plug comprising:

a base having a triangular axial cross section; and a plug connecting interface and first and second spades extending from said plug connecting interface, wherein said first and second spades are in a standard configuration.

* * * * *